United States Patent [19]

Ohe et al.

[11] Patent Number: 4,804,967

[45] Date of Patent: Feb. 14, 1989

[54] VEHICLE ANTENNA SYSTEM

[75] Inventors: Junzo Ohe; Hiroshi Kondo, both of Aichi, Japan

[73] Assignee: Toyota Jidosha Kabushiki Kaisha, Toyota, Japan

[21] Appl. No.: 924,555

[22] Filed: Oct. 29, 1986

[30] Foreign Application Priority Data

| | | | |
|---|---|---|---|
| Oct. 29, 1985 | [JP] | Japan | 60-243611 |
| Oct. 30, 1985 | [JP] | Japan | 60-244717 |
| Oct. 31, 1985 | [JP] | Japan | 60-245367 |

[51] Int. Cl.[4] ..... H01Q 1/32

[52] U.S. Cl. ..... 343/712

[58] Field of Search ..... 343/711, 712, 713, 741, 343/744

[56] References Cited

U.S. PATENT DOCUMENTS

| | | | |
|---|---|---|---|
| 2,200,674 | 5/1940 | McDonald, Jr. | 343/712 |
| 2,212,253 | 8/1940 | Stief | 343/712 |
| 2,404,093 | 7/1946 | Roberts | 343/712 |
| 2,481,978 | 9/1949 | Clough | 343/712 |
| 2,520,986 | 9/1950 | Williams et al. | 343/712 |

(List continued on next page.)

FOREIGN PATENT DOCUMENTS

| | | | |
|---|---|---|---|
| 0889618 | 7/1949 | Fed. Rep. of Germany . | |
| 1131762 | 6/1962 | Fed. Rep. of Germany . | |
| 7015306 | 4/1970 | Fed. Rep. of Germany . | |
| 2425189 | 12/1974 | Fed. Rep. of Germany . | |
| 2701921 | 7/1978 | Fed. Rep. of Germany . | |
| 2745475 | 4/1979 | Fed. Rep. of Germany . | |
| 2821202 | 11/1979 | Fed. Rep. of Germany . | |
| 2733478 | 4/1980 | Fed. Rep. of Germany . | |
| 1949828 | 4/1980 | Fed. Rep. of Germany . | |
| 53-22418 | 8/1978 | Japan . | |
| 0046617 | 4/1980 | Japan | 343/712 |
| 59-44861 | 3/1984 | Japan . | |
| 9195811 | 12/1984 | Japan . | |
| 60-1008 | 6/1985 | Japan . | |
| 60-1009 | 6/1985 | Japan . | |
| 60-1010 | 6/1985 | Japan . | |
| 60-1011 | 6/1985 | Japan . | |
| 60-1012 | 6/1985 | Japan . | |
| 0129464 | 8/1985 | Japan . | |

OTHER PUBLICATIONS

English Translations of Japanese Publications, 60-1008; 60-1009; 60-1010; 60-1011; 60-1012; 59-195811.

English Translation of German patent 1949828 (Submitted Earlier).

Abstract of 55-88407 Antenna Device, 12/78.

Abstract of 60-169204 On Vehicle Antenna System, 10/84.

Abstract of 60-172804 Antenna System for Vehicle, 10/84.

European Search Report.

Japanese Pat. Abstract, vol. 6, No. 37 E-97, Mar. 6, 1982, 56-156031.

Japanese Pat. Abstract, vol. 6, No. 55 E-101, 4/10/82, 56-168441.

Japanese Pat. Abstract, vol. 7, No. E-187, 7/15/83, 58-70640.

Japanese Pat. Abstract, vol. 7, No. E-187, 7/15/83, 58-70642.

*Primary Examiner*—William L. Sikes

*Assistant Examiner*—Doris J. Johnson

*Attorney, Agent, or Firm*—Cushman, Darby & Cushman

[57] ABSTRACT

The present invention provides a vehicle antenna system embedded in the vehicle body for efficiently detecting external waves and transmitting the detected signals to an onboard receiver. The antenna system includes a metallic armor member arranged extending along the vehicle body and electrically insulated from the vehicle frame and an antenna element disposed in close proximity to the metallic armor member without outwardly extending from the vehicle body. The metallic armor member is preferably a side molding on the vehicle body. The antenna element is in the form of an antenna wire or loop antenna disposed extending along the length of the side molding. The antenna element is intersected by an alternating field created by the surface currents on the metallic armor member to generate high frequency currents in the antenna element, the generated currents being then transmitted directly to the onboard receiver through a cable.

4 Claims, 5 Drawing Sheets

U.S. PATENT DOCUMENTS

| | | | |
|---|---|---|---|
| 2,575,471 | 11/1951 | Schweiss et al. | 343/712 |
| 2,740,113 | 3/1956 | Hemphill | 343/787 |
| 2,774,811 | 12/1956 | Shanok et al. | 343/712 |
| 2,859,441 | 11/1958 | Rosenbaum | 343/713 |
| 2,950,479 | 8/1960 | Pan | 343/702 |
| 2,971,191 | 2/1961 | Davis | 343/712 |
| 3,007,164 | 10/1961 | Davis | 343/712 |
| 3,066,293 | 11/1962 | Davis | 343/713 |
| 3,210,766 | 10/1965 | Parker | 343/702 |
| 3,364,487 | 1/1968 | Maheux | 343/702 |
| 3,611,388 | 10/1971 | Okumura | 343/712 |
| 3,717,876 | 2/1973 | Volkers | 343/712 |
| 3,728,732 | 4/1973 | Igarashi | 343/712 |
| 3,742,508 | 6/1973 | Tomaszewski | 343/713 |
| 3,794,997 | 2/1974 | Iwatsuki et al. | 343/712 |
| 3,823,403 | 7/1974 | Walter et al. | 343/708 |
| 3,916,413 | 10/1975 | Davis | 343/712 |
| 3,961,292 | 6/1976 | Davis | 343/712 |
| 3,961,330 | 6/1976 | Davis | 343/713 |
| 3,972,048 | 7/1976 | Davis | 343/712 |
| 4,003,056 | 1/1977 | Davis | 343/704 |
| 4,080,603 | 3/1978 | Moody | 343/712 |
| 4,217,591 | 8/1980 | Czerwinski | 343/713 |
| 4,278,980 | 7/1981 | Ogita et al. | 343/748 |
| 4,317,121 | 2/1982 | Allen | 343/712 |
| 4,339,827 | 7/1982 | Torres et al. | 455/188 |
| 4,499,606 | 2/1985 | Rambo | 455/277 |
| 4,506,267 | 3/1985 | Harmuth | 343/744 |
| 4,566,133 | 1/1986 | Rambo | 455/277 |
| 4,633,519 | 12/1986 | Gotoh et al. | 455/277 |

VEHICLE ANTENNA SYSTEM

BACKGROUND OF THE INVENTION

1. Field of the Invention

The present invention relates to an improved vehicle antenna system which can efficiently detect broadcast waves received by the vehicle body and transmit the detected waves to various onboard receivers.

2. Description of the Prior Art

A pole type antenna is known as one of the conventional vehicle antenna systems. The pole antenna projects exteriorly from the vehicle body and exhibits a favorable reception performance in its own way. However, the pole antenna was always an obstruction the design of vehicle body.

The pole antenna also is disadvantageous in that it may accidentally or intentionally be subjected to damage and in that the pole antenna may produce unpleasant noises during vehicle running at high speeds. Therefore, it is desirable to eliminate the pole antenna from the vehicle body.

Recently, the number of frequency bands, of broadcast or communication waves to be received on automobiles is being increased. If a plurality of pole antennas are located on a vehicle body matching the increased number of frequency bands, the aesthetic appearance of the vehicle is degraded. Furthermore, electrical interference between the pole antennas remarkably degrades the reception performance.

Some attempts have been made to eliminate or conceal pole antennas. One such attempt is that an antenna wire is applied to a rear window glass on a vehicle body.

Another proposal has been made to detect surface currents induced on the vehicle body by broadcast waves. Although it appears that such a proposal apparently provides the most positive and efficient method of utilizing the surface currents flowing on the vehicle body, many actual experiments showed that the method failed, contrary to the above expectation.

One main reason why the surface currents on the vehicle body could not be utilized is that the level of the surface currents is not as large as expected. The prior art mainly intended to detect surface currents flowing on the roof panel of the vehicle body. However, the surface currents on the roof panel could not reach a level sufficient to be utilized in the vehicle antenna system.

The second reason is that the surface currents include noises. The noises are created mainly from the engine ignition system and the battery charging regulator system and therefore cannot be eliminated when the engine is running.

There have been some proposals to overcome such problems. For example, Japanese Patent Publication Sho 53-22418 discloses a vehicle antenna system for utilizing surface currents induced on the vehicle body by broadcast waves, in which an electrical insulator is formed on the vehicle body at a location where the surface currents flow concentratedly. The currents are detected directly by a sensor between the opposite ends of the electrical insulator. It is sure that such an arrangement can detect practicable signals being superior in S/N ratio. However, the vehicle body must partially be cut away to form a space for housing the antenna construction. This is not acceptable in the mass-production of automobiles.

Japanese Utility Model Publication Sho 53-34826 discloses an antenna system comprising a pickup coil for detecting currents on the pillar of the vehicle body. Such a proposal is certainly advantageous in that the antenna can completely be housed within the vehicle body. However, it is not practical since the pickup coil has to be disposed near the pillar in the direction perpendicular to the length of the pillar. Furthermore, such an arrangement cannot provide practicable antenna outputs and appears to be merely an impractical idea.

As described above, the prior art was not necessarily successful in providing an antenna system which detects currents induced on the vehicle body by broadcast waves.

Particularly, the prior art could not provide a proper pickup construction for efficiently detecting currents induced on the vehicle body by broadcast waves and a proper pickup arrangement for obtaining practicable S/N ratios. Rather, many experiments suggested that the antenna system utilizing the surface currents on the vehicle body could not be accomplished.

SUMMARY OF THE INVENTION

It is therefore an object of the present invention to provide an improved antenna system for small-sized vehicles, which can efficiently detect currents induced on the vehicle body by broadcast waves and transmit the detected signals to onboard receivers.

To this end, the present invention provides a vehicle antenna system comprising antenna means disposed in close proximity to the marginal portion of the vehicle body, the antenna means being adapted to detect high frequency surface currents having a frequency equal to or higher than a predetermined level and to transmit the detected signals directly to onboard receiver means.

More particularly, the antenna system according to the present invention comprises a metallic armor member disposed to extend along the surface of the vehicle body and electrically insulated from the vehicle frame and antenna means rigidly mounted on the armor member and electrically insulated from the armor member, the antenna means being adapted to pick up signals and to transmit the picked-up signals to various onboard receivers.

The metallic armor member is preferably a side molding, a roof retainer, a front window molding and others. The metallic armor member is electrically insulated from the vehicle frame by the use of a plastic spacer or fastener means to increase the density of high frequency surface currents induced on the surface of the metallic armor member.

The length of the metallic armor member may be determined to be equal to about a half-wavelength for lower bands (1 ch.–3 ch.) of VHF bands, about one wavelength for higher bands (4 ch.–11 ch.) and about two–four wavelengths for UHF bands. With these bands, surface currents flow on the vehicle body more concentratedly increase the sensitivity in the antenna system.

The prior art antenna systems mainly intended to receive AM band waves meeting the needs of the times. Therefore, the prior art antenna systems for detecting the surface currents on the vehicle body would not obtain good reception characteristics, because the wavelength of broadcast waves to be received is too long for the antenna systems. The inventors aimed at this dependency on the frequency and determined to limit broadcast waves to be received to broadcast waves having frequencies equal to or higher than FM frequency bands (normally, 50 MHz). Thus, the reception of broadcast waves from surface currents on the vehicle body, which was considered to be impossible, can very efficiently be made in accordance with the present invention.

The inventors also aimed at the fact that the high frequency surface currents are distributed on the vehicle body in very different levels. As a location suitable to dispose the vehicle antenna system, the inventors selected one of various vehicle parts where the density of the currents induced by broadcast waves is higher with less noise, such as a side molding, a roof retainer, a front window molding or the like. The antenna means is preferably in the form of an antenna wire or loop antenna.

In order to positively detect the high frequency currents belonging to the aforementioned range of frequency bands, moreover, the antenna means is positioned extending along the marginal edge of the metallic armor member and spaced apart from that marginal edge within a distance represented by:

$$12\times10^{-3}C/f\ (m)$$

where c is the velocity of light and f is the carrier frequency. If the length of the antenna wire is adjusted depending on the frequency band to be received, the reception can further be improved.

DESCRIPTION OF PREFERRED EMBODIMENTS

Figure 8:
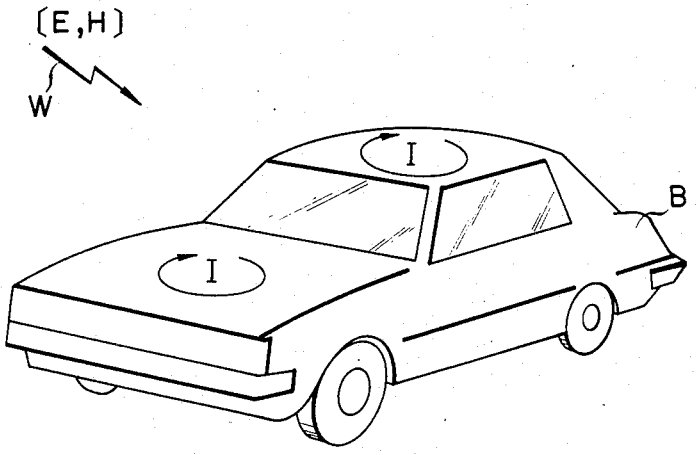
FIG. 8 illustrates surface currents I induced on a vehicle body B by external waves W.
Figure 9:
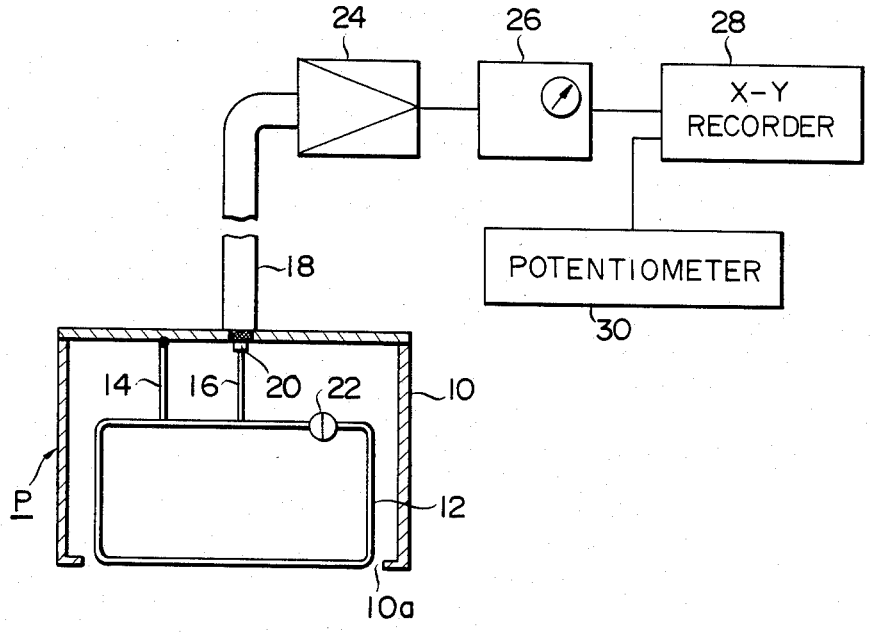
FIG. 9 illustrates a probe and its processing circuit used to determine the distribution of surface currents on the vehicle body.
Figure 10:
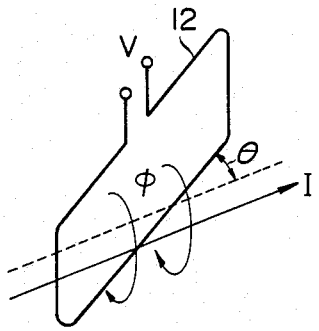
FIG. 10 illustrates the electromagnetic coupling between the surface currents I and a pickup loop antenna.

Referring first to FIGS. 8 through 10, there will be described a process of measuring the distribution of high frequency currents on the vehicle body and determining a location at which an antenna system according to the present invention can most efficiently receive broadcast waves, prior to the detailed description of preferred embodiments of the present invention.

FIG. 8 shows that as external waves W such as broadcast waves and other waves pass through a vehicle body B of conductive metal, surface currents I of various different levels are induced on the vehicle body B at various different locations, depending on the intensity of the external waves. The present invention intends only to receive external waves having frequencies which belong to relatively high frequency bands equal to or higher than 50 MHz, such as FM band waves, TV band waves.

For such particular high frequency bands, the present invention is characterized by that a pickup is located on the vehicle body at a location at which the density of the surface currents is higher with less noise.

The distribution of surface currents is determined by a computer simulation and actual measurements of current level at various vehicle locations. The present invention uses a probe which is constructed in accordance with the same principle as that of a high frequency pickup mounted on the vehicle body at a desired location, as will be described. The probe is moved along the surface of the vehicle body throughout the entire area thereof while varying its orientation at the respective locations on the vehicle body.

FIG. 9 shows the schematic construction of such a probe P which comprises a casing 10 of conductive material for avoiding the ingress of external waves and a loop coil 12 housed within the casing 10. The casing 10 is provided with an opening 10*a* through which a portion of the loop coil 12 is externally exposed. The exposed portion of the loop coil 12 is disposed in close proximity to the surface of the vehicle body B such that a magnetic flux created by the surface currents on the vehicle body can be detected by the loop coil 12. The loop coil 12 is electrically connected with the casing through a short-circuiting line 14. The output end 16 of the loop coil 12 is electrically connected with a core conductor 20 in a coaxial cable 18. The loop coil 12 includes a capacitor 22 for causing the frequency of the loop coil 12 to resonate with a desired frequency to be measured to improve the pickup efficiency.

As seen from FIG. 9, the output of the probe P is amplified by a high frequency voltage amplifier 24 the output voltage of which can be measured at a high frequency voltage meter 26. The output voltage of the amplifier 24 also is recorded by an X-Y recorder 28 as one of the current levels at the respective locations of the vehicle body. The X-Y recorder 28 also receives a signal indicative of the respective one of various locations on the vehicle body. In such a manner, the level of the high frequency surface currents at that location can be determined. As the probe P is moved along the surface of the vehicle body B while angularly rotating at the respective locations of measurement, therefore, the distribution and orientation of the surface currents on the vehicle body can accurately be determined.

Figure 11:
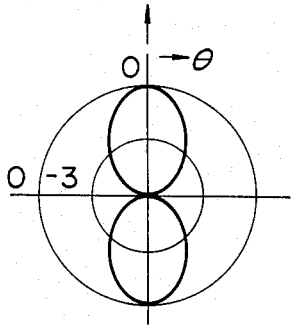
FIG. 11 illustrates the directional pattern of the loop antenna shown in FIG. 10.

FIG. 10 shows a declination e between the high frequency surface currents I and the loop coil 12 of said probe. As shown, a magnetic flux $\phi$ created by the currents I causes a detection voltage V to generate in the loop coil 12 when the magnetic flux $\phi$ intersects the loop coil 12. As seen from FIG. 11, the detection voltage V becomes maximum when the declination o is equal to zero, that is, when the surface currents I are parallel to the loop coil 12 of the probe. Thus, the orientation of the surface currents I can be determined when the maximum voltage is obtained by rotating the probe P at each of the locations on the vehicle body.

Figure 12:
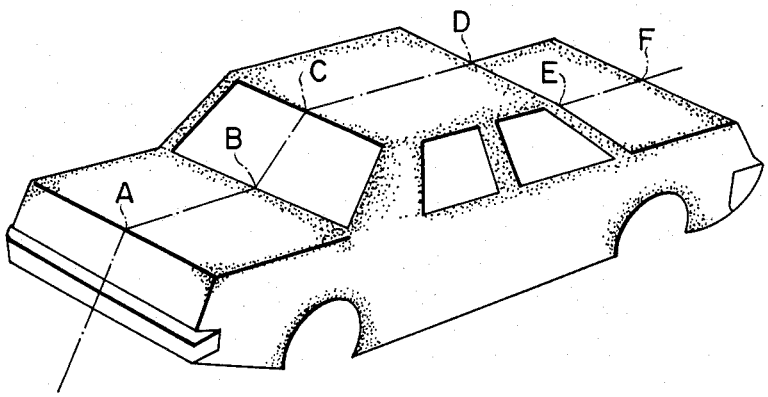
FIG. 12 illustrates the distribution of surface current intensity on the vehicle body.
Figure 13:
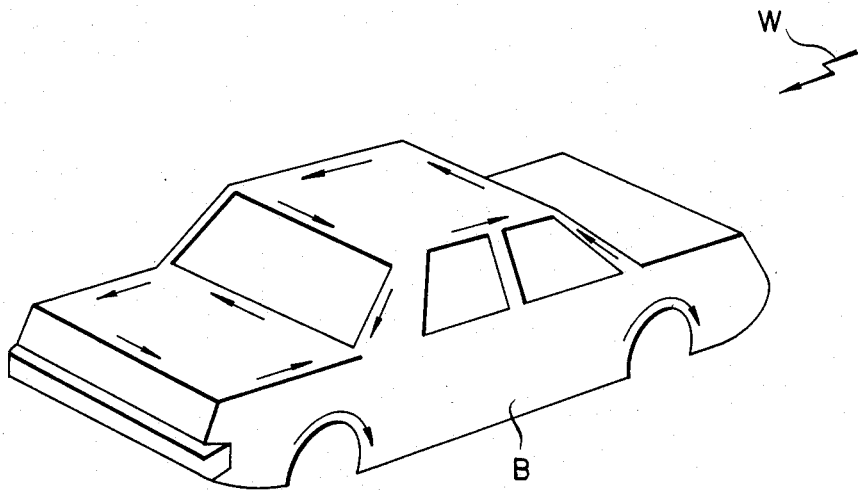
FIG. 13 illustrates the orientation of surface currents on the vehicle body.

FIGS. 12 and 13 show the magnitude and orientation of the high frequency surface currents at the respective vehicle locations for a frequency equal to 80 MHz, such magnitude and orientation of the surface currents being obtained from both the computer simulation and the actual measurements by said probe P. As seen from FIG. 12, the magnitude of the surface currents is larger at locations extending along the marginal edges of flat sections on the vehicle body and becomes very small at the central portion of each of the flat vehicle sections.

As seen from FIG. 13, the surface currents flow concentrically on the vehicle body in the direction parallel to each of the marginal portions of the vehicle body or extending along each of the connections between each adjacent flat section.

Studying the distribution of surface currents induced on the aforementioned metallic vehicle portion along the longitudinal line A on the vehicle body, it has been found that the level of the surface currents decreases as a distance apart from the end or marginal portion of the vehicle body increases. Since the range of current level in which actually acceptable sensitivities can be obtained is equal to or less than 6 decibels, it is understood that very good sensitivity can be obtained if the distance from any edge of the vehicle body is within 4.5 centimeters.

In accordance with the present invention, the antenna wire is electrically insulated from the outer surface of the vehicle body B such as a side molding, a roof retainer, a front window molding or the like and also arranged extending along the edge of that outer surface. In order to obtain very good sensitivity in practice, the distance apart from the edge is preferably set within a range depending on the carrier frequency of the broadcast waves.

For example, if the antenna wire is spaced apart from the marginal edge of the vehicle body within 4.5 centimeters for the carrier frequency equal to 80 MHz, a sufficiently practicable antenna system can be provided in accordance with the present invention.

From the computer simulation and the actual measurements, it has been found that such practicable distance varies depending on the carrier frequency to be used and that the practicable distance decreases as the level of the carrier frequency increases.

From the fact that the practicable distance is inversely proportional to the level of the carrier frequency, a good reception for each of the carrier frequencies can be made if the high frequency pickup is spaced apart from the marginal portion of any flat metal part on the vehicle body within a range represented by:

$$12\times10^{-3}\ c/f\ (m)$$

where c is the velocity of light and f is a carrier frequency.

For example, the antenna wire may be disposed spaced apart from the marginal portion of the vehicle body within 3.6 centimeters for a carrier frequency equal to 100 MHz. As the level of the carrier frequency f increases, the antenna wire must correspondingly be approached to the marginal edge of the vehicle body.

First Embodiment

Figure 1:
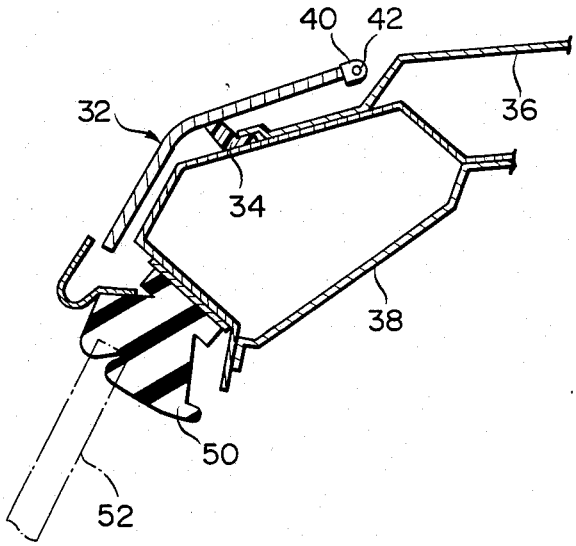
FIG. 1 illustrates a first embodiment of a vehicle antenna system constructed according to the present invention, which is applied to a side molding.

Referring now to FIG. 1, there is shown a first embodiment of the present invention which is applied to a side molding on the vehicle body. A metallic side molding 32 is disposed along the vehicle body and electrically insulated from the other vehicle parts such as a roof panel 36 and an inner header panel 38 through a plastic spacer 34. The inner header panel 38 is connected with a side window glass 52 through a weather strip 50. The side molding 32 includes a plastic part 40 integrally molded thereover at one edge and extending along the length of the side molding 32. An antenna wire 42 is embedded in the plastic part 40 such that the antenna wire 42 can positively be positioned in place within a range depending on the level of a carrier frequency to be received.

The side molding 32 may be formed to have its length equal to about a half-wavelength for lower frequency bands in VHF bands (1 ch.–3 ch. in Japan), about one wavelength for higher frequency bands, and about 2–4 wavelengths for UHF bands. For these frequency bands, the surface currents more concentrically flow on the vehicle body to obtain an increased receiving sensitivity.

To this end, the antenna wire 42 and the plastic part 40 are simultaneously molded on the molding or the paint of the side molding 32. The assembly can more easily be made. The antenna wire 42 is disposed in close proximity to the marginal edge of the side molding 32 and electrically insulated from that marginal edge. Thus, a magnetic flux induced by the high frequency surface currents flowing on said marginal edge can positively be detected by the antenna wire 42. As a result, the currents induced on the vehicle body can more sensitively be detected by the antenna system according to the present invention.

Figure 2:
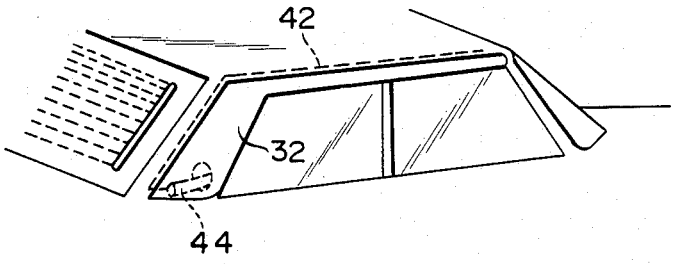
FIG. 2 is a perspective view of the antenna wire arranged along the side molding.
Figure 3:
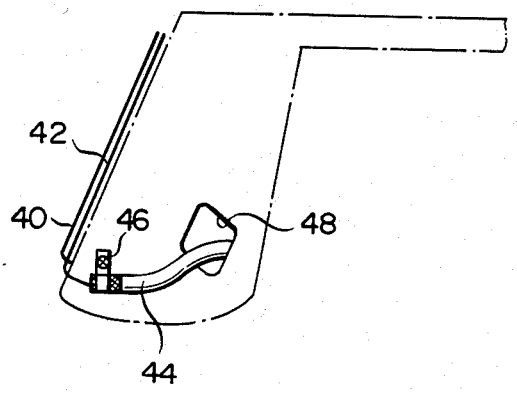
FIG. 3 illustrates the connection of the antenna wire with a coaxial cable.

FIG. 2 shows the outline of the antenna wire 42 mounted on the marginal edge of the side molding 32 while FIG. 3 indicates the connection of the antenna wire with a coaxial cable 44.

More particularly, the antenna wire 42 includes a free end located at the plastic part 40 with the other end thereof electrically connected with the core of the coaxial cable 44. The coaxial cable 44 also includes a sheath conductor connected with the vehicle frame by means of a bracket 46. The coaxial cable 44 extends into the interior of the vehicle body through a service hole 48 which is formed in the vehicle frame backside of the side molding 32. The coaxial cable 44 is electrically connected with an onboard receiver (not shown) which has circuitry containing a preamplifier and other instruments for processing signals transmitted from the antenna wire through the coaxial cable.

Figure 4:
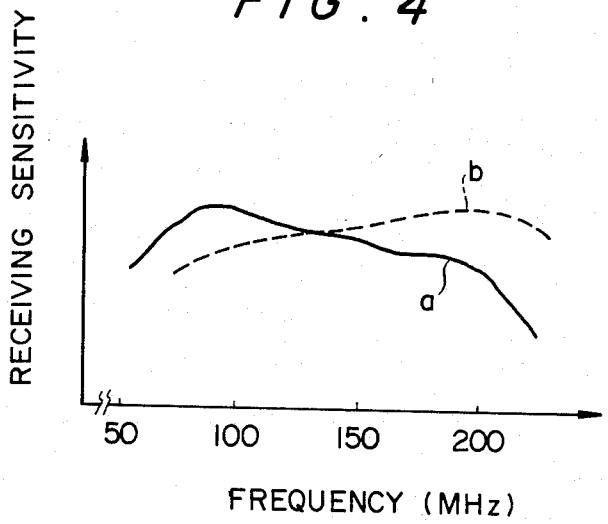
FIG. 4 is a graph showing the characteristics of receiving sensitivity in the first embodiment.

FIG. 4 shows the receiving sensitivity of the antenna wire in the first embodiment wherein a curve a indicates the sensitivity of the antenna wire 42 having its length equal to 1800 mm and a curve b represents the sensitivity of the antenna wire having its length equal to 900 mm. As seen from FIG. 4, the reception may be improved by adjusting the length of the antenna wire 42 dependent on a frequency band to be received.

As will be apparent from the foregoing, the first embodiment of the present invention may easily be assembled onto the vehicle since the antenna wire is integrally molded on the armor member on molding and painting it. The first embodiment of the present invention also is inexpensive to manufacture since the antenna wire forms part of the armor member. Any particular adjustment is not required on assembling since the frequency bands to be received can easily be selected by adjusting the length of the antenna wire.

Second Embodiment

Figure 5:
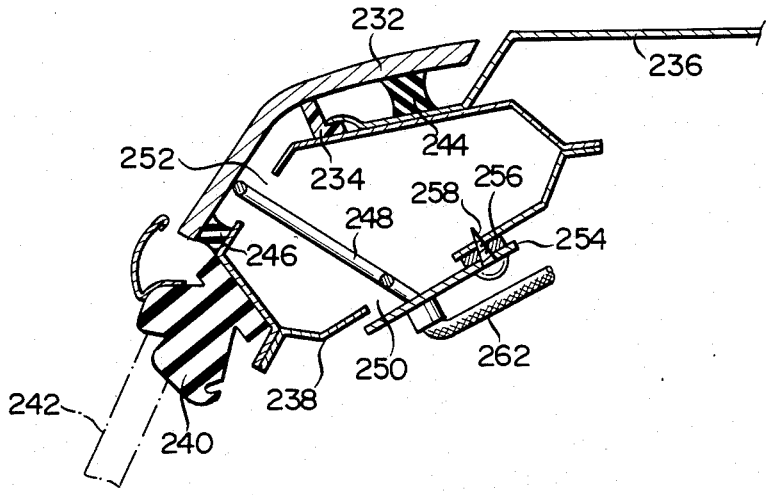
FIG. 5 illustrates a second embodiment of a vehicle antenna system constructed according to the present invention, which is applied to a side molding.

Referring next to FIG. 5, there is shown a second embodiment of a vehicle antenna system according to the present invention which is applied to a side molding on the vehicle body.

In FIG. 5, a metallic side molding 232 is arranged extending along the vehicle body and electrically insulated from a roof panel 236 and an inner header panel 238 by means of a plastic spacer 234. The inner header panel 238 is connected with a side window glass 242 through a weather strip 240. Other weather strips 244 and 246 for preventing the ingress of rainwater are located between the inner periphery of the side molding 232 and the inner header panel 238.

The inner header panel 238 includes openings 250 and 252 formed therethrough and used to mount a loop antenna 248 defining antenna means according to the present invention. The loop antenna 248 is disposed in close proximity to the inner face of the side molding 232 through the openings 250 and 252.

More particularly, the inner header panel 238 includes a substrate 254 located to close the opening 250. The substrate 254 is mounted on the inner header panel 238 by means of fasteners 258 through spacers 256.

Figure 6:
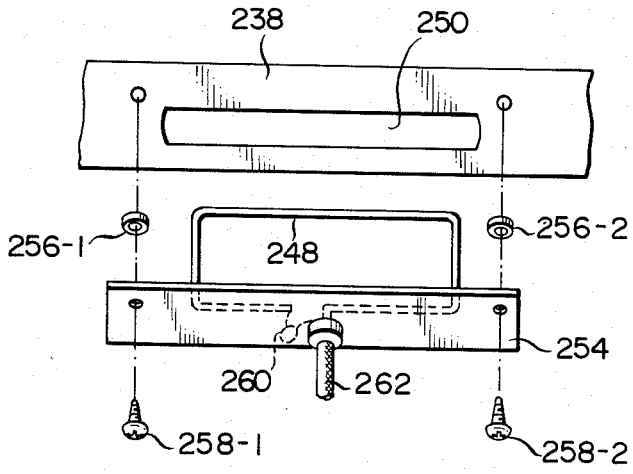
FIG. 6 illustrates the mounting of the antenna system shown in FIG. 5.

The loop antenna 248 is in the form of a single winding. As shown in FIG. 6, a resonance capacitor 260 is electrically connected in series between the single winding antenna 248 and the sheath conductor of a coaxial cable 262. The loop antenna 248 is coated with an insulating material such that it can be disposed in intimate contact with the side molding 232 and also electrically insulated from the side molding 232. Thus, a magnetic flux created by the surface currents can more intensively intersect the loop antenna 248.

In such an arrangement, the loop antenna 248 is pressed against the surface of the side molding 232 and located spaced apart from the edge of the side molding 232 within the distance represented by:

$$12\times10^{-3}\ c/f\ (m)$$

where c is the velocity of light and f is the carrier frequency. Thus, the reception can more sensitively be made. High frequency signals thus detected are supplied to the onboard receiver through the coaxial cable 262 and then processed by the circuitry in the receiver.

The side molding 232 may be formed to have its length equal to about half-wavelength for lower frequency bands in VHF bands (1 ch.–3 ch.), about a one wavelength for higher frequency bands, and about 2–4 wavelengths for UHF bands. For these frequency bands, the surface currents more concentratedly flow on the vehicle body to obtain an increased receiving sensitivity.

The metallic armor member may be a part other than the side molding, for example, a front window glass molding or a rear window glass molding.

As will be apparent from the foregoing, the level of the induced currents can be increased to improve the receiving sensitivity by electrically separating the vehicle frame from the metallic armor member.

Since the antenna system can completely be housed within the vehicle frame, any part of the antenna system will not extend inwardly into the interior of the vehicle passenger room with the space thereof being maintained as it is.

Third Embodiment

Figure 7:
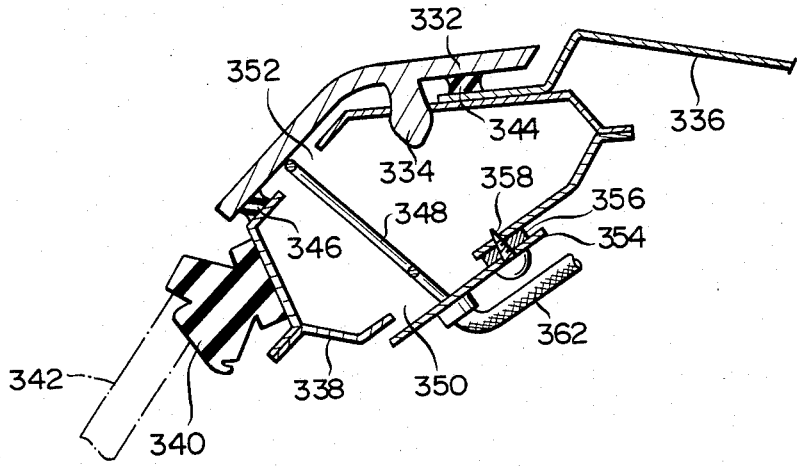
FIG. 7 illustrates a third embodiment of a vehicle antenna system constructed according to the present invention, which is applied to a side molding.

Referring next to FIG. 7, there is shown a third embodiment of a vehicle antenna system according to the present invention which is applied to a side molding on the vehicle body.

In FIG. 7, a metallic side molding 332 is rigidly mounted on an inner header panel 338 by means of a fastener 334 which extends outwardly from the inner wall of the side molding 332 and fitted into an opening in the inner header panel 338. The inner header panel 238 is arranged extending along the vehicle body and electrically insulated from a roof panel 336.

The inner header panel 338 is connected with a side window glass 342 through a weather strip 340. Other weather strips 344 and 346 for preventing the ingress of rainwater are located between the inner periphery of the side molding 332 and the inner header panel 338.

The inner header panel 338 includes openings 350 and 352 formed therethrough and used to mount a loop antenna 348 defining antenna means according to the present invention. The loop antenna 348 is disposed in close proximity to the inner face of the side molding 332 through the openings 350 and 352.

More particularly, the inner header panel 338 includes a substrate 354 located to close the opening 350. The substrate 354 is mounted on the inner header panel 338 by means of fasteners 358 through spacers 356.

In such a manner, the respective mountings of the side molding 332 and antenna system on the inner header panel 338 and vehicle frame can be simplified to reduce the number of assembling steps.

The loop antenna 348 is in the form of a single winding. As in the second embodiment, a resonance capacitor is electrically connected in series between the single winding antenna 348 and the sheath conductor of a coaxial cable 362. The loop antenna 348 is coated with an insulating material such that it can be disposed in intimate contact with the side molding 332 and also electrically insulated from the side molding 332. Thus, a magnetic flux created by the surface currents can more intensively intersect the loop antenna 348.

In such an arrangement, the loop antenna 348 is pressed against the surface of the side molding 332 and located spaced apart from the edge of the side molding 332 within the distance represented by:

$$12\times10^{-3}\ c/f\ (m)$$

where c is the velocity of light and f is the carrier frequency. Thus, the reception can more sensitively be made. High frequency signals thus detected are supplied to the onboard receiver through the coaxial cable 362 and then processed by the circuitry in the receiver.

According to the third embodiment of the present invention, the antenna system can improve its receiving sensitivity and increase its producibility since no spacer and other similar means for electrically insulating between the vehicle frame and the metallic armor member are required. Any control of the gap and electric conduction between the vehicle frame and the metallic armor member is not required since the metallic armor member includes fastener means extending outwardly from the inner wall of the metallic armor member, the fastener means being adapted to mount the metallic armor member on the vehicle frame under the electric conductive state.

Thus, the present invention provides a vehicle antenna system which comprises a metallic armor member arranged extending along the vehicle body and disposed in electric conduction with the vehicle frame and antenna means disposed in close proximity to the metallic armor member and capable of picking up high frequency surface currents induced on the metallic armor member, whereby a superior reception can more sensitively be made with less noise.

We claim:

1. A vehicle antenna system for detecting high frequency surface currents which are induced on the marginal portion of the vehicle body by broadcast waves and flow concentratedly on the marginal vehicle portion, the marginal portion of the vehicle body including a side molding member extending along the vehicle and insulating means for electrically insulating the side molding member from the vehicle frame, said antenna system comprising:

antenna means disposed in close proximity opposite a marginal end portion of the side molding member, said antenna means comprising a loop antenna and being electrically insulated from the side molding member by application of an insulated coating on said antenna means, said antenna means being provided for detecting signals from the surface currents flowing on the side molding member and for outputting the detected signals to an onboard receiver; and mounting means for mounting said antenna means through an opening in an inner header panel so that said loop antenna extends to a location near the inner face of the side molding member.

2. A vehicle antenna system as defined in claim 1 wherein said antenna means has one free end with the other end thereof connected with a coaxial cable in the passenger room of the vehicle body through service hole means which is provided in the vehicle frame.

3. A vehicle antenna system as defined in claim 1 wherein said loop antenna is in the form of a single winding, one end of said single winding being electrically connected in series with the sheath conductor of a coaxial cable through a resonance capacitor.

4. A vehicle antenna system as defined in claim 1 wherein said antenna means is spaced apart from the marginal edge of the side molding member within a range represented by:

$$12\times10^{-3}\ c/f\ (m)$$

where c is the velocity of light and f is a carrier frequency.

* * * * *